US005429351A

United States Patent [19]

Hanson

[11] Patent Number: 5,429,351

[45] Date of Patent: Jul. 4, 1995

[54] GAME APPARATUS

[76] Inventor: Thomas E. Hanson, 24041 Farmington Rd., Farmington, Mich. 48336

[21] Appl. No.: 245,969

[22] Filed: May 19, 1994

[51] Int. Cl.[6] ..... A63B 65/00

[52] U.S. Cl. ..... 273/58 F; 273/415

[58] Field of Search ..... 273/415, 65 A, 58 F

[56] References Cited

U.S. PATENT DOCUMENTS

| | | | |
|---|---|---|---|
| 1,669,198 | 5/1928 | Greer | 273/65 A |
| 3,937,470 | 2/1976 | Stahlberger, Jr. et al. | 273/415 |
| 5,056,795 | 10/1991 | Buhrow | 273/415 X |

OTHER PUBLICATIONS

Preliminary patent search results (see attached).

*Primary Examiner*—William H. Grieb

*Attorney, Agent, or Firm*—Chase & Yakimo

[57] ABSTRACT

A hand bag for striking by a back of a game player's hand comprises first and second panels stitched about their periphery and containing fluid pellets of a high density polyethylene material therein. Lacing further extends about the stitched periphery to further secure the panels while protecting the initial stitching. The panels are configured to complement the back of the user's hand so that upon striking a desired lift and airborne flight is imparted to the bag.

7 Claims, 4 Drawing Sheets

GAME APPARATUS

BACKGROUND OF THE INVENTION

This invention relates to a hand bag for a game use and, more particularly, to a device designed to be kept aloft with lift afforded by the back of the game player's hands during game play.

The use of objects in various games which are to be kept in the air is well known. Game devices such as Frisbees®, Hacky Sacks®, balls etc. are utilized with various types of game rules, if any, so as to provide enjoyment to the game players.

Such games and devices employed therein are known to assist in the development of one's eye/foot and eye/-hand coordination. To further such development it is desirable to provide a game device which is kept aloft by the back of the game player's hand. Accordingly, such a device would further facilitate hand to eye coordination skills which have otherwise been developed by devices which are usually grasped by the user.

In response thereto I have invented a device designed for airborne movement in connection with various types of game rules, herein referred to as a "hand bag" for purposes of description and not limitation. The hand bag is kept aloft by offering lift thereto with the back of one's hand. The shape of the hand bag allows for efficient contact with the back of the hand when properly struck so as to increase the efficacy of the hand bag in game use and the subsequent user enjoyment offered thereby.

My now preferred hand bag generally presents a device gradually disk-like in configuration and filled with a disk-like filler material. The device is preferably made of a garment suede leather with the filler material being made by an "underwater pelletized" method utilizing high density polyethylene (HDPE). The hand bag is secured together by stitching and exterior leather lacing so as to maintain the integrity of the hand bag during use.

It is therefore a general object of the invention to provide a hand bag for use as an airborne device in various games of play.

Another general object of the invention is to provide a hand bag, as aforesaid, which is kept aloft during game play by lift offered by the back of the hand of the game player.

Another object of this device is to provide a hand bag, as aforesaid, which develops eye/hand coordination.

A still further object of this invention is to provide a hand bag, as aforesaid, which is utilized in various games for the development of skills transferrable to other sports.

Another particular object of this invention is to provide a hand bag, as aforesaid, which presents structure adapted for efficient lift upon proper contact with the back of the hand during game play.

Still another particular object of this invention is to provide a hand bag, as aforesaid, which presents a structure for efficient contact by the back of the hand of the game player.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
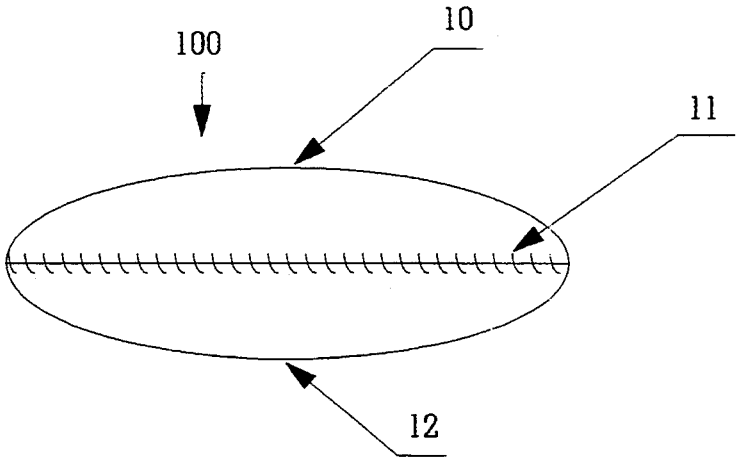
FIG. 1 is a full scale, side view of the hand bag.
Figure 2:
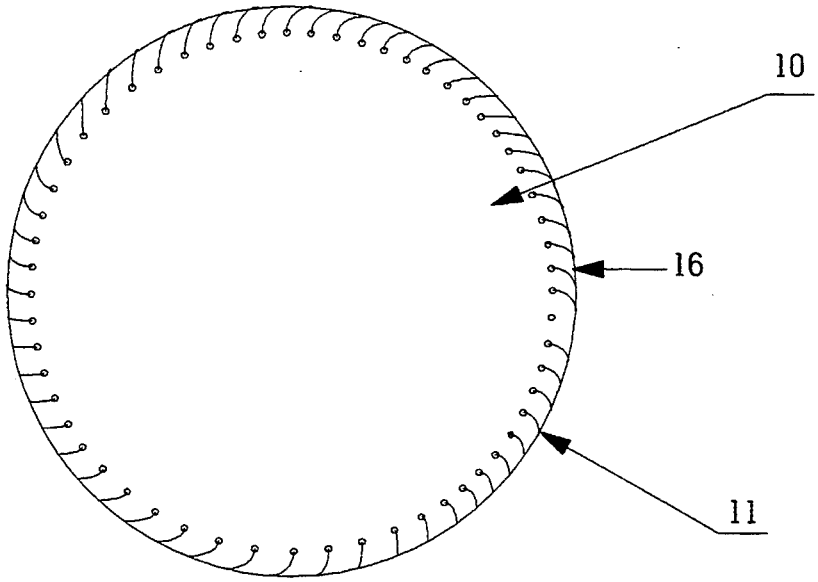
FIG. 2 is a full scale, top view of the hand bag of FIG. 1.
Figure 3:
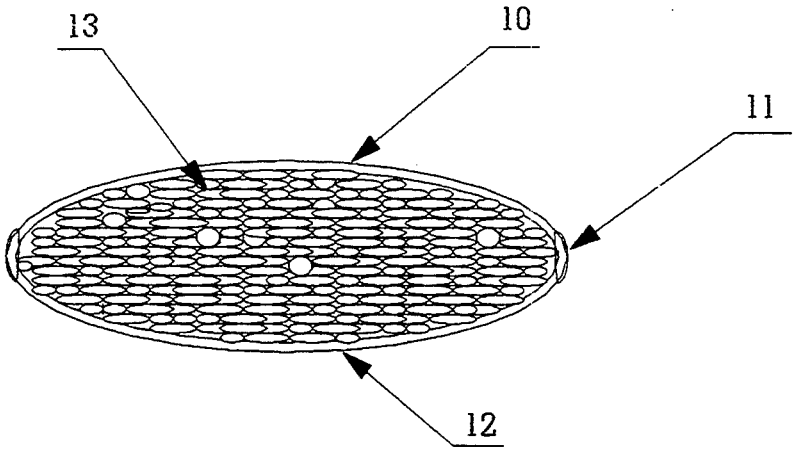
FIG. 3 is a longitudinal sectional view of the hand bag of FIG. 1 showing the inner filler material.

Turning more particularly to the drawings, FIG. 1 illustrates the hand bag 100 as generally comprising an upper panel 10 and a lower panel 12 secured together by central peripheral stitching and exterior lacing 11. The hand bag 100 is now preferably approximately 3.00 inches along its longitudinal axis and 1.00 inch high along its vertical axis when the hand bag 100 is filled with the filler pellet material 13. The panels 10, 12 are preferably constructed of a garment-type suede leather so as to provide a suitable durability, resilience and flexibility for prolonged game use.

Figure 4A:
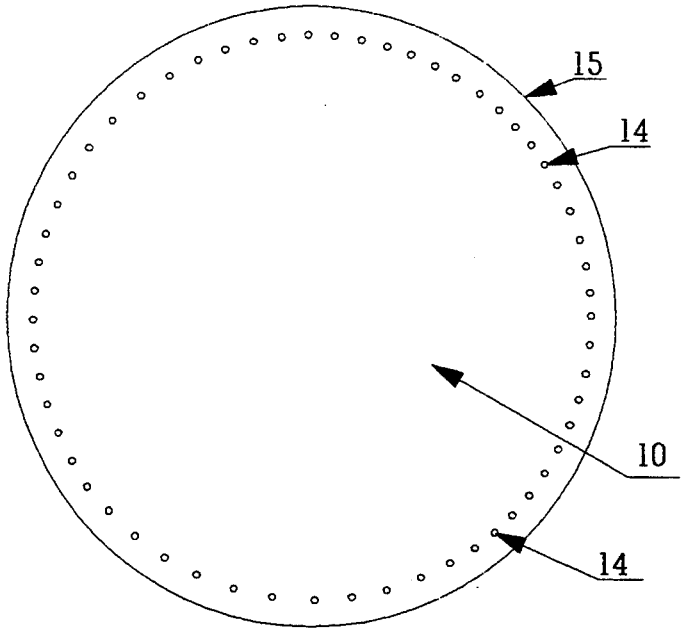
FIG. 4 is a full scale, plan view showing the separated top and bottom panels of the hand bag.
Figure 4B:
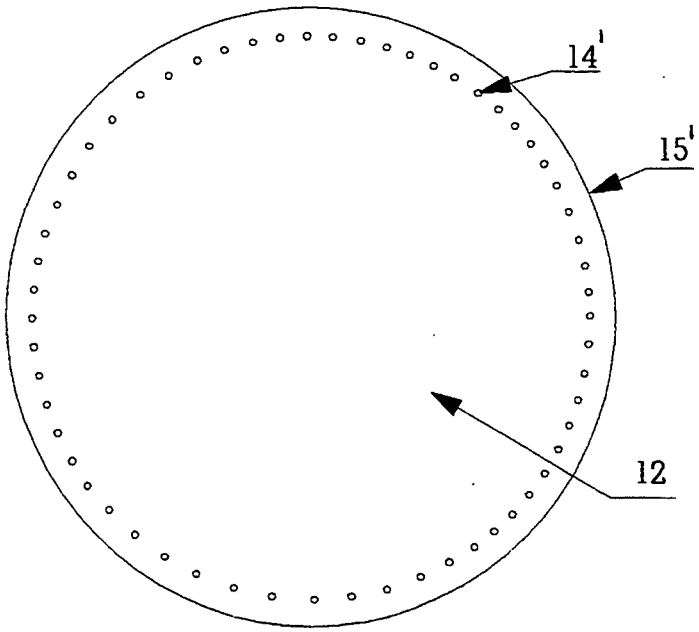

The panels 10, 12 are identical in configuration as shown in FIG. 4. Each circular, congruent panel 10, 12 presents a plurality of inwardly displaced apertures 14 about the circumference which are to receive the exterior lacing 11 therethrough. As shown the diameter of each panel is approximately 3.25 inches prior to assembly.

During assembly the panels 10, 12 are first aligned with the exterior surfaces facing one another. The peripheries 15, 15' of the panels 10, 12 are stitched together such that an opening 16 is left between the two panels 15, 15'. Upon turning the joined panels 10, 12 inside out the sewn together peripheries 15, 15' are now on the interior of the bag. High density polyethylene pellets (HDPE) 13 are then inserted through opening. Subsequently, one end of the lacing 11 is knotted and inserted through an aperture 15 adjacent the opening. The lacing 11 is then passed through the adjoining apertures 15, 15' about the upper 10 and lower 12 panels until arriving at the opening 16 from the opposed side thereof. After insertion of approximately two ounces of the pellets 13 through the opening, the free end of the lacing 11 is knotted with the knot placed on the interior of the bag 100 with the opening 16 then sewn shut. Accordingly, the hand bag 100 now presents a FIG. 1 configuration having a continuous lacing 11 intertwined around the previously sewn periphery of the hand bag 100. This lacing further secures the panels 10, 12 and protects the stitching from direct contact during game use so as to prolong hand bag 100 life.

As best shown in FIG. 1 this construction presents upper and lower surfaces presenting an area approximating/complementing the average area presented by the back of a player's hand. As shown, a disk-like configuration of the resulting hand bag 100 is now preferred. As the hand bag 100 is not entirely filled with the pellets 13 the pellets are allowed to move relative to each other along the imaginary longitudinal (3.0") and vertical axes (1.0"). Thus, the struck panel 10 or 12 of the hand bag 100 will deform when properly contacted by the back of the game player's hand. Such deformation allows the panel 10 or 12 adjacent the back of the hand to depress and/or conform to the hand back while the opposing panel expands. This structural reaction provides a proper lift to the hand bag upon a proper striking of the bag 100 with the back of the hand, such striking usually provided by a matching of the back of the hand with the panel surface.

During striking the rounded surfaces of the disk-like pellets 13 allow for a fluid-like movement within the confines of the side panels 10, 12. Thus, relative movement of the pellets 13 are provided which allows the hand bag 100 to change shape as above described.

In use various games can be played involving either sole or multiple users with the purpose of the game to keep the hand bag 100 aloft by utilizing the back of the hand. In game playing involving multiple users the users may sit in a circle or around a table or the like so as to maintain game play while enjoying each other's company.

It is understood that various types of games may be utilized according to the game rules decided upon by the users. During such use the hand/eye coordination, balance and other attributes will be approved along with manual dexterity.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. A game hand bag comprising:

a pair of congruent upper and lower circular panels formed of a resilient material and each presenting a periphery, said panels presenting congruent surfaces;

a line of stitching for joining said panel peripheries in alignment to present a housing therebetween, said stitching allowing for a maximum allowable displacement between said panels at an imaginary common vertical axis passing through a center of each panel;

a plurality of pellets disposed within said housing, said pellets displacing said aligned panels at a minimum at said aligned peripheries and successively increasing to a maximum at the common vertical axis, said pellets cooperating with said panels to present a generally ellipsoid configuration to said hand bag;

lacing extending about said stitched panel peripheries and across said line of stitching for maintaining said line of stitching of said panel peripheries and said ellipsoid configuration of said hand bag, whereby contact of the panels of the hand bag with a back of a player's hand imparts effective lift thereto.

2. The device as claimed in claim 1 wherein said panels are of a garment suede material.

3. The device as claimed in claim 1 wherein said lacing is of a leather material, said lacing projecting beyond the sewn periphery to defer direct contact of said stitching during hand bag use.

4. The device as claimed in claim 1 wherein said pellets are rounded in configuration to allow fluid movement therebetween.

5. The device as claimed in claim 1 wherein each panel is approximately three inches in diameter.

6. The device as claimed in claim 1 wherein said displacement between said panels of said hand bag at said central axis is approximately one inch.

7. The device as claimed in claim 1 wherein said pellets between said panels increase in quantity from said panel peripheries towards said central axis.

* * * * *